US005983887A

United States Patent [19]

Bourgeois

[11] Patent Number: 5,983,887

[45] Date of Patent: Nov. 16, 1999

[54] REFLECTOR OVEN

[76] Inventor: Edward T. Bourgeois, 8 Cherry St., Belmont, Mass. 02178

[21] Appl. No.: 09/288,989

[22] Filed: Apr. 9, 1999

[51] Int. Cl.[6] ..... A21B 1/00

[52] U.S. Cl. ..... 126/274; 126/9 R; 126/30

[58] Field of Search ..... 126/9 R, 9 A, 126/9 B, 25 R, 29, 30, 274

[56] References Cited

U.S. PATENT DOCUMENTS

| | | | |
|---|---|---|---|
| 216,003 | 5/1879 | Watson . | |
| 240,639 | 4/1881 | Austin . | |
| 449,432 | 3/1891 | Watson . | |
| 548,499 | 10/1895 | Ashmore . | |
| 897,459 | 9/1908 | Grant . | |
| 1,216,008 | 2/1917 | Stonebridge . | |
| 1,490,274 | 4/1924 | Ivey . | |
| 2,520,030 | 8/1950 | Cliff | 126/274 |
| 2,543,115 | 2/1951 | Lindstaest | 126/274 |
| 2,580,925 | 1/1952 | Jarvis | 126/274 |
| 2,757,664 | 8/1956 | McDowell | 126/274 |
| 2,921,577 | 1/1960 | Smith | 126/274 |
| 3,026,866 | 3/1962 | Lynch | 126/274 |
| 4,508,096 | 4/1985 | Marogil | 126/30 |
| 5,243,961 | 9/1993 | Harris | 126/9 R |

*Primary Examiner*—James C. Yeung
*Attorney, Agent, or Firm*—Sharon L. Day

[57] ABSTRACT

A portable, collapsible reflector oven useful for cooking by an open fire is provided. The inventive apparatus is constructed as a single unit in that all of the parts of the reflector oven are connected to one another to prevent part loss. The reflector oven has a stabilizing frame to which the reflector panels and supporting panels are pivotally attached. In a preferred embodiment, the reflector oven is provided with a shelf and a shelf suspension system. The shelf suspension system automatically positions the shelf correctly when the reflector oven is unfolded from a collapsed position. In the most preferred embodiment, the reflector oven has a latching system which acts to stabilize the reflector oven against collapse while the reflactor oven is in the open position.

20 Claims, 6 Drawing Sheets

REFLECTOR OVEN

FIELD OF THE INVENTION

The present invention relates to a reflector oven that can be collapsed for ease of transport or erected in a stabilized position for cooking.

BACKGROUND OF THE INVENTION

Travelers to remote areas, such as for example, hunters, campers and canoers frequently use an open fire to bake, roast, and grill their food. Special ovens termed reflector ovens are especially useful for baking and roasting food where an open fire is the heat source. Examples of reflector ovens are shown in U.S. Pat. Nos. 2,757,664 (McDowell) and 2,921,577 (Smith), the disclosure of each of which is incorporated herein by reference. However, reflector ovens can be bulky and difficult for such travelers to transport. Thus, a means to minimize the space required by the reflector oven is desirable. Examples of collapsible reflector ovens are shown in U.S. Pat. Nos. 216,003 (Watson); 240,639 (Austin); 449,432 (Watson); 548,499 (Ashmore); 897,459 (Grant); 1,216,008 (Stonebridge); 1,490,274 (Ivey); 2,543,115 (Lindstaedt) and 2,580,925 (Jarvis), the disclosure of each of which is incorporated herein by reference.

Previous reflector ovens have suffered from various problems such as a lack of consideration of the amount of storage space required to accommodate the reflector oven when it is packed for travel; insufficient strength of construction to support the weight of food to be cooked; and lack of sufficient space for placing for cooking. Additionally, when the oven is in use it must be sturdy, stable, and durable so that the oven may be moved relative to the fire. The temperature reached in the reflector oven is regulated by changing the position of the reflector oven relative to the open fire. Thus, when the reflector oven is in the open, non-collapsed position and food is placed on the shelf for cooking, the reflector oven must be sturdy and stable enough to allow the oven to be moved while food is on the shelf.

SUMMARY

The present invention is a reflector oven which can be folded as a single unit for storage and which can be locked into a stable unit when in its unfolded, open position. The reflector oven in accordance with the present invention comprises a frame, a heat reflector panel, a shelf, a suspension system for the shelf, a latching means, a support panel having a means for engaging the latching means, and a handle. Surprisingly, the handle in the support panel remains sufficiently cool that the handle can be used to adjust the position of the reflector oven before an open fire or for serving the food cooked therein. The support panel can have a foot that is shaped to enhance the stability of the reflector oven when the reflector oven is seated on uneven ground. The latching means prevents the reflector oven from folding when positioned proximal to the frame engaging the support panel. The heat reflector, the shelf, the support panel and latching means are all pivotally connected, so that when the reflector oven is closed or folded into a flattened, collapsed position, all parts remain attached one to the other. In a first embodiment of the heat reflector, the heat reflector comprises a top heat reflector panel which is connected to a back panel at the top edge of the back panel, and a bottom heat reflector panel which is connected to the bottom edge of the back panel.

In the preferred embodiment, the suspension system for the shelf functions to automatically transport the shelf into proper alignment with the other components of the reflector oven when the oven is opened and to transport the shelf into its appropriate position when the oven is collapsed. It also supports the shelf when the reflector oven is in the open position. In one embodiment, the suspension system for the shelf is a wire that is seated in a sleeve at the front-most edge of the shelf and that is mounted to the top heat reflector panel by a bracket. The bracket is seated approximately half way between the front and the back edges of the top heat reflector panel In a preferred embodiment of the latching means, the latching means comprises a wire shaped into a rectangle where one side of the rectangle is pivotally mounted at the juncture of the back edge of the top heat reflector panel and the top edge of the back panel. When fitted into a slot in a support panel or panels, pivoting of the wire so that the support panel or panels are pressed and secured against the edge of the shelf stabilizes the reflector oven, so that the reflector oven can be lifted as a unit.

The reflector oven folds or collapses at a number of pivot points for ease of storage and transport. In the preferred embodiment, a pivot point comprises a sleeve or hinge and a central core such as a wire about which the sleeve or hinge rotates. The wire may be totally enclosed or partially enclosed. When a panel edge is curled or rolled back upon itself, it is termed a sleeve. When a panel edge has a toothed pattern and the teeth-like extensions of one panel are curled and are align with those of another panel to encircle the wire, it is termed a hinge. Alternatively, a bracket mount is used to support a wire and form a pivot point. Preferably, the front edges of each of the top heat reflector panel, the bottom heat reflector panel, and the two support panels are substantially at right angles one to the other and have sleeves through which a single wire is passed, thus providing a frame. The sleeves permit the panels to rotate or pivot about the wire frame.

To close the reflector oven, the latching wire first arm is rotated from the open, front of the oven towards the back of the oven and the side arms of the latching wire are disengaged each from their respective slots in the support panels. Pivoting the support panels about their respective frame wire arm, flattening them against the front of the oven, and folding the reflector panels and back panel one on top of the other, collapses the oven.

DESCRIPTION OF THE PREFERRED EMBODIMENTS

The reflector oven in accordance with the present invention comprises at least one heat reflector panel, a shelf, a suspension system for the shelf, a support panel, a frame for pivotally connecting the support panel to the heat reflector panel, and a means for latching the oven in an open position by securing the support panel against the shelf side edge and the heat reflector side edge, wherein the aforementioned all fold (also termed collapse) or unfold (also termed open) as a unit. When folded, the support panel is rotated approximately 90°, so that the support panel, the heat reflector panel, the back panel, and the shelf panel stack substantially one on top of the other. When the reflector oven is unfolded, the shelf and each heat reflector panel automatically position themselves in the appropriate location when the support panel(s) is positioned against the shelf edge.

Figure 1:
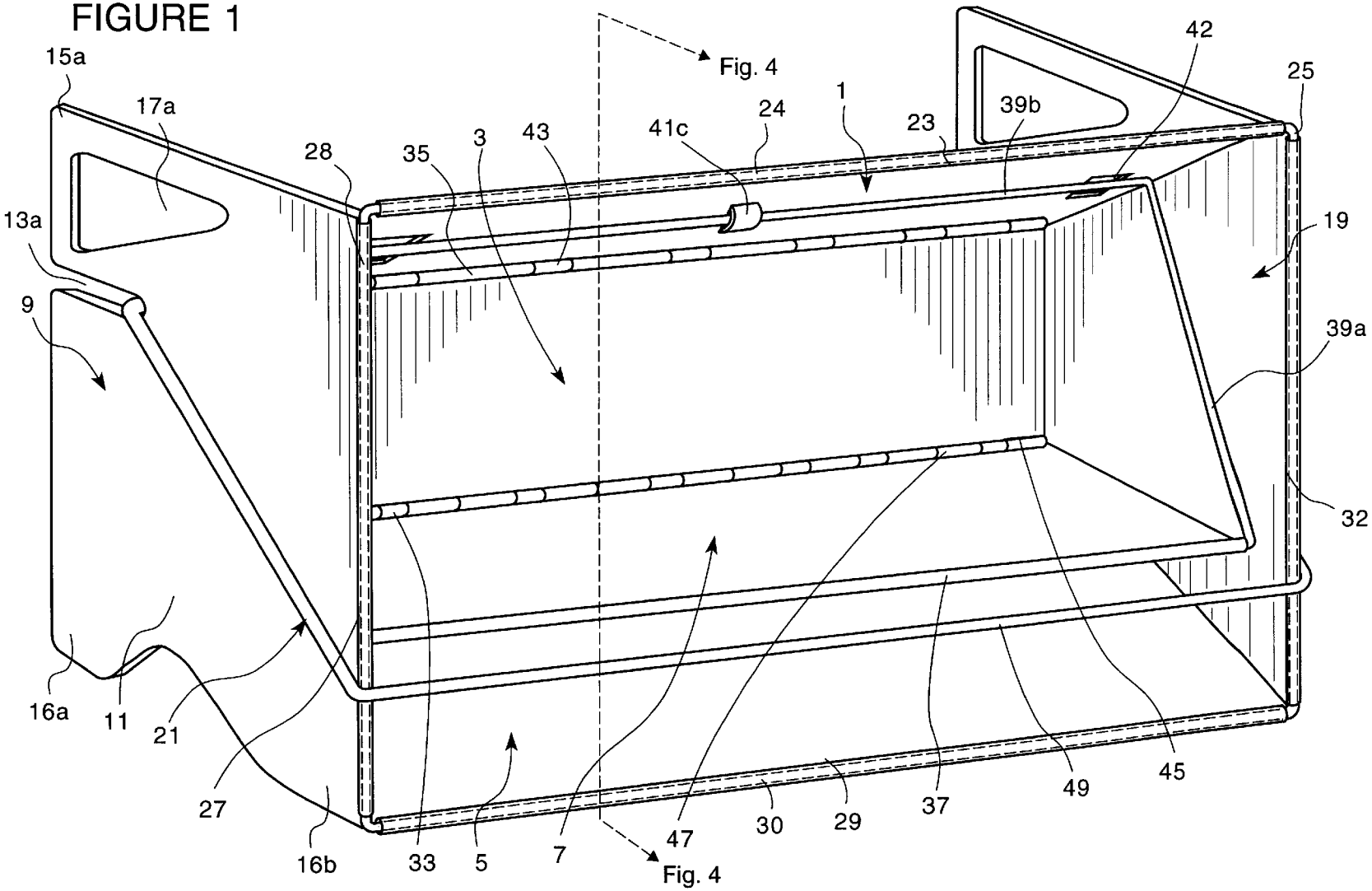
FIG. 1 illustrates a perspective view of the front of a first embodiment of the instant invention when it is in the open position.

Referring now to FIG. 1, an illustrative embodiment of the reflector oven is shown in the open, latched position. The illustrative embodiment of the reflector oven comprises a top heat reflector panel 1, a back panel 3, a bottom heat reflector panel 5, a shelf 7, a suspension system for the shelf, a first support panel 9, a second support panel 19, a means for latching the reflector oven in the open position, and a frame wire 25. The suspension system for the shelf comprises a sleeve 37 at the front edge of the shelf 7 for receiving an arm of the suspension system wire 39, a suspension system wire having a first arm 39*a* and a second arm 39*b;* a bracket, generally referenced throughout as 41, for receiving an arm 39*b* of the suspension system wire, an aperture 42 in the top reflector panel 1 for receiving the bracket 41, and the top heat reflector panel 1 for supporting the bracket at the bracket wings 41*a,* 41*b* (shown in FIG. 2B). The bracket is seated approximately half way between the front edge and the back edge of the top heat reflector panel. The means for latching comprises a latching wire 21 having a first arm 49 and a planar, rectangular shape and a support panel 9 having a slot 13*a* for receiving an arm of the latching wire. Other means for latching the oven in the open position will be apparent to those skilled in the art. Where these are within the scope of the invention, these are also meant to be included.

The individual pieces of the oven pivot about one another at sleeve or hinge and wire pivot points, so that none are lost or separated from the unit as a whole. As shown in FIG. 1, each panel is connected to at least one other panel at a wire or at a pivot point. An arm of the latching wire (illustrated in FIG.5) is mounted in a hinge comprising the back edge 43 of the top heat reflector panel and the top edge 35 of the back panel, thereby forming a pivot point at which the panels are connected. A pivot wire 31 (illustrated in FIG. 5) is seated within a hinge comprising the back edge 47 of the shelf 7, the back edge 45 of the bottom heat reflector panel 5 and the bottom edge 33 of the back panel 3. A support panel 9 and a heat reflector panel 1, each have a sleeve 28, 24 respectively, for receiving a wire, such as a frame wire. The frame wire acts both to form a pivot point with the sleeve and to add rigidity to the open face of the reflector oven.

The frame wire 25 forms a rectangular frame to which each of the top heat reflector panel 1, the first support panel 9, the bottom heat reflector panel 5 and the second support panel 19 is pivotally attached at sleeves 24, 28, 30, 32 respectively. Each sleeve is seated at the front edge of a panel, for example sleeve 24 is at top heat reflector edge 23. Sleeve 28 is seated at the front edge 27 of supporting panel 9. The pivot points or functional hinges are more clearly illustrated in FIGS. 3 and 4. A back panel 3 is seated between the top heat reflector panel 1 and the bottom heat reflect panel 5, thus more useful space for cooking is available.

The first support panel 9 has a bottom edge region 11*a* having a back leg 16*a* and a front leg 16*b*. A slot 13*a* for receiving the latching means is present in the back edge of the support panel 9 and extends towards the front edge of that support panel. A handle 17*a* in the form of a triangular aperture is present in the support panel 9. The handle is bounded by a top edge region 15*a* around which a hand can be fitted to lift the reflector oven. Preferably, a second support panel having the same configuration as the first support panel is present as illustrated. Movement to reposition the reflector oven relative to the fire can be used to regulate the temperature in the reflector oven or the reflector oven can be moved when serving the food. The legs are shaped to facilitate leveling of the shelf when the reflector oven is seated upon uneven ground.

The width of each of the heat reflector panels is defined herein as the distance between the front edge of the respective panel (or the top edge if it is the back panel) and the back edge of respective panel (or the bottom edge of the back panel). Where a top and a bottom heat reflector panel are present, the width of the top and the width of the bottom heat reflector panels should be approximately equal. The back panel width should be approximately half the width of a heat reflector panel.

Figure 2A:
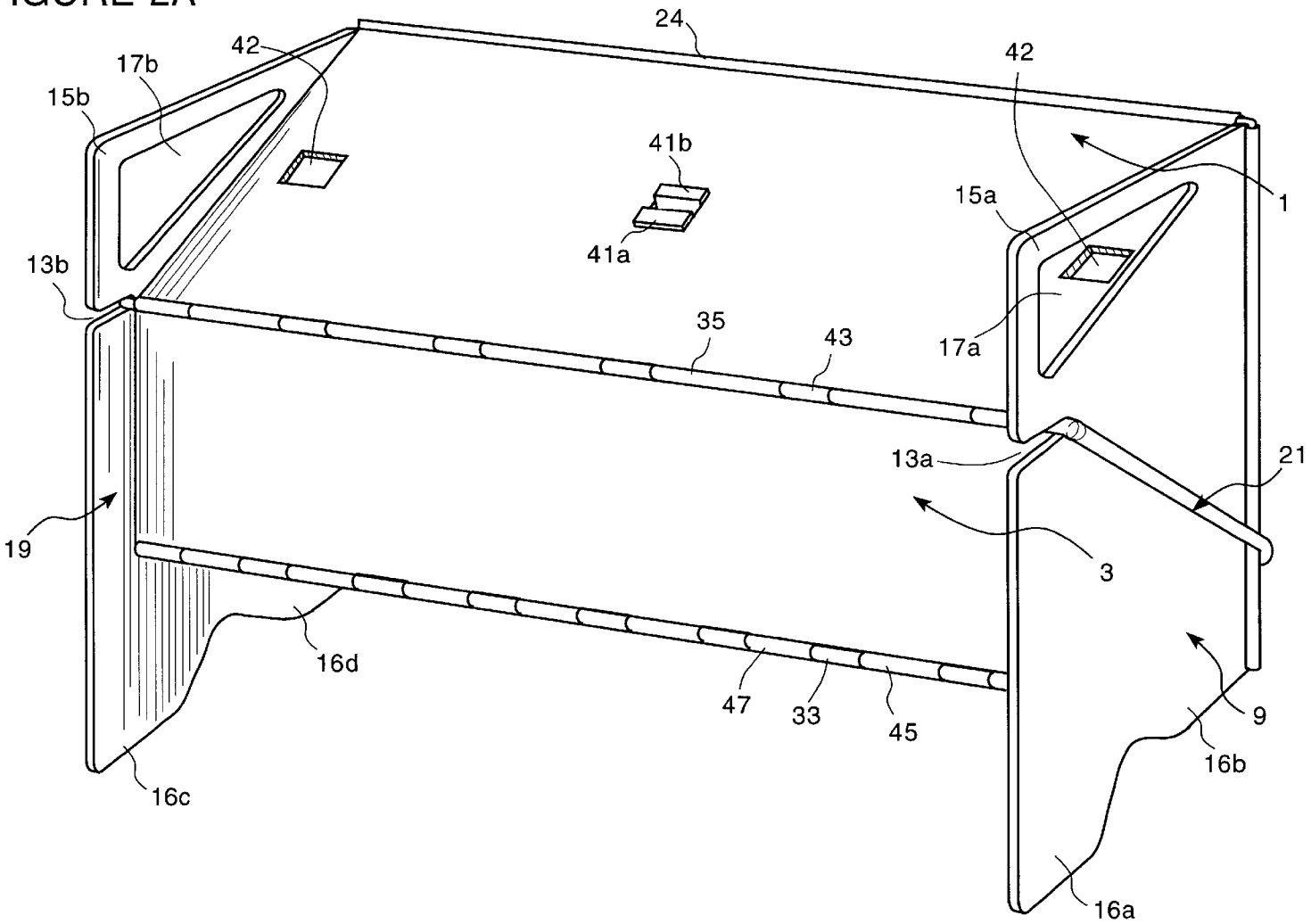
FIG. 2A illustrates a perspective view of the back of the reflector oven of FIG. 1 showing the cutouts for a clip for supporting a wire for suspending a shelf.

FIG. 2A provides a perspective view from the back of the reflector oven when the reflector oven is in an open, latched position for cooking. The support panels 9, 19 respectively; the back panel 3; the back panel bottom edge 33; the top heat reflector panel 1; and the bottom heat reflector panel back edge 45 are illustrated. A cutout 42 for receiving a u-shaped clip 41 which serves as a bracket is seen in the top heat reflector panel. The u-shaped clip has two wings 41*a,* 41*b* respectively which support it in the top heat reflector panel. The u-shaped clip provides one embodiment of a mounting bracket useful in the cutout. Other means for supporting the wire for supporting the shelf are also envisioned.

The two support panels 9, 19 each having a front foot 16*b,* 16*d* respectively, and a back foot 16*a,* 16*c* respectively, a slot 13*a,* 13*b* respectively and having a handle which is an aperture 17*a,* 17*b* bounded by a top support panel region 15*a,* 15*b* respectively are shown held against the side edges of the top heat reflector panel by a wire 21. The top heat reflector panel back edge 43 and the back panel top edge 35 are bent to form a sleeve in which a length of the latching wire 21 is seated. A sleeve for receiving a hinge wire is formed by the back edge of the shelf 47, the bottom edge of the back panel 33, and the back edge of the bottom heat reflector panel 45.

Figure 2B:
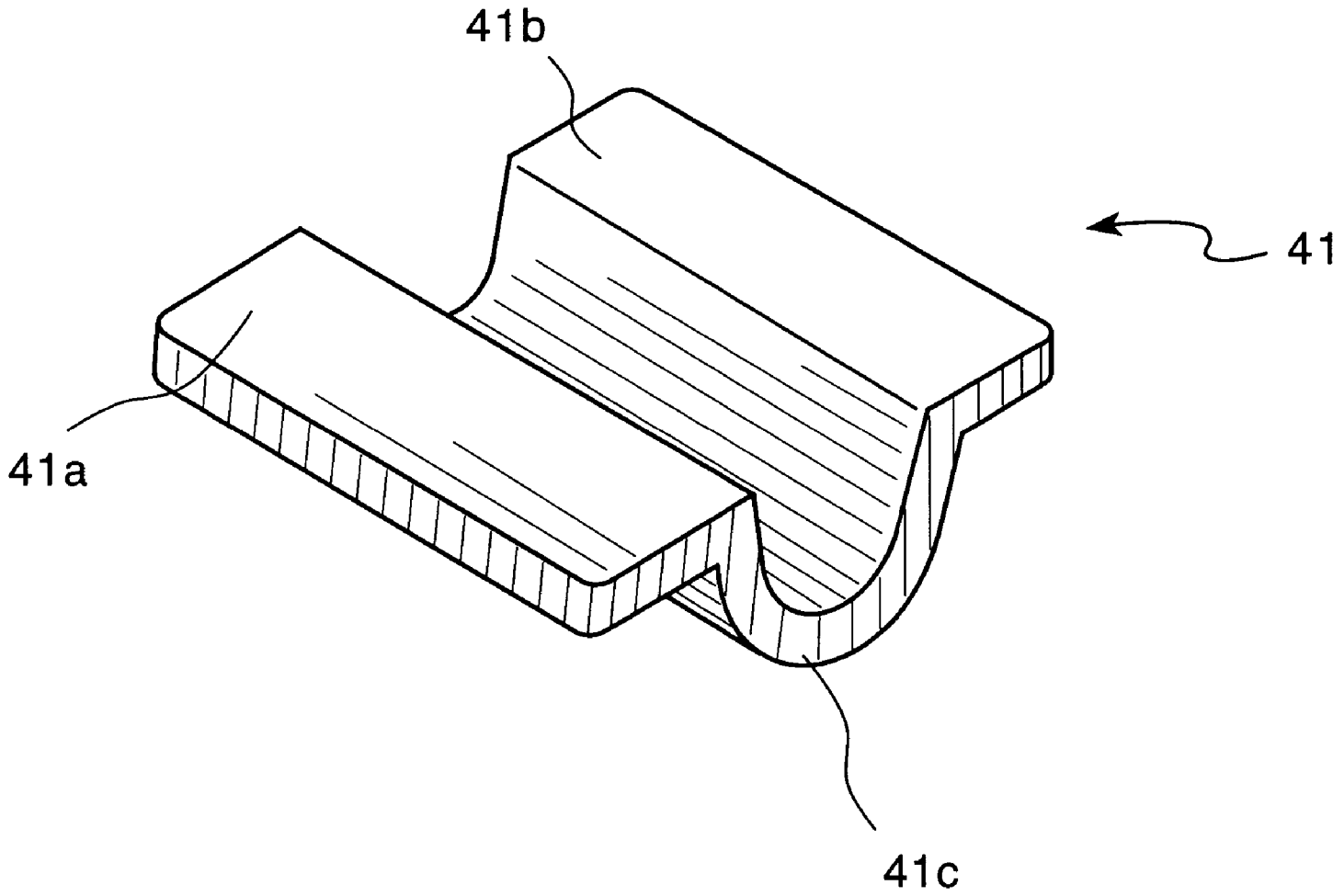
FIG. 2B illustrates a perspective view of a clip useful for insertion into the cutouts shown in FIG. 2A.

FIG. 2B provides an enlarged view of the u-shaped clip 41 which is an example of an embodiment of a mounting bracket of the shelf support system. The u-shaped clip has two side wings 41*a,* 41*b,* respectively that extend from either side of a u-shaped body 41*c.* The u-shaped body is sized to receive a supporting wire for the shelf within which the supporting wire can rotate. The u-shaped clip is sized to fit into the cutouts in the top heat reflector panel. When the u-shaped clips are seated in the cutouts and the supporting wire is seated in the u-shaped body 41*c,* the u-shaped clips are secured in the top reflector panel.

Figure 3:
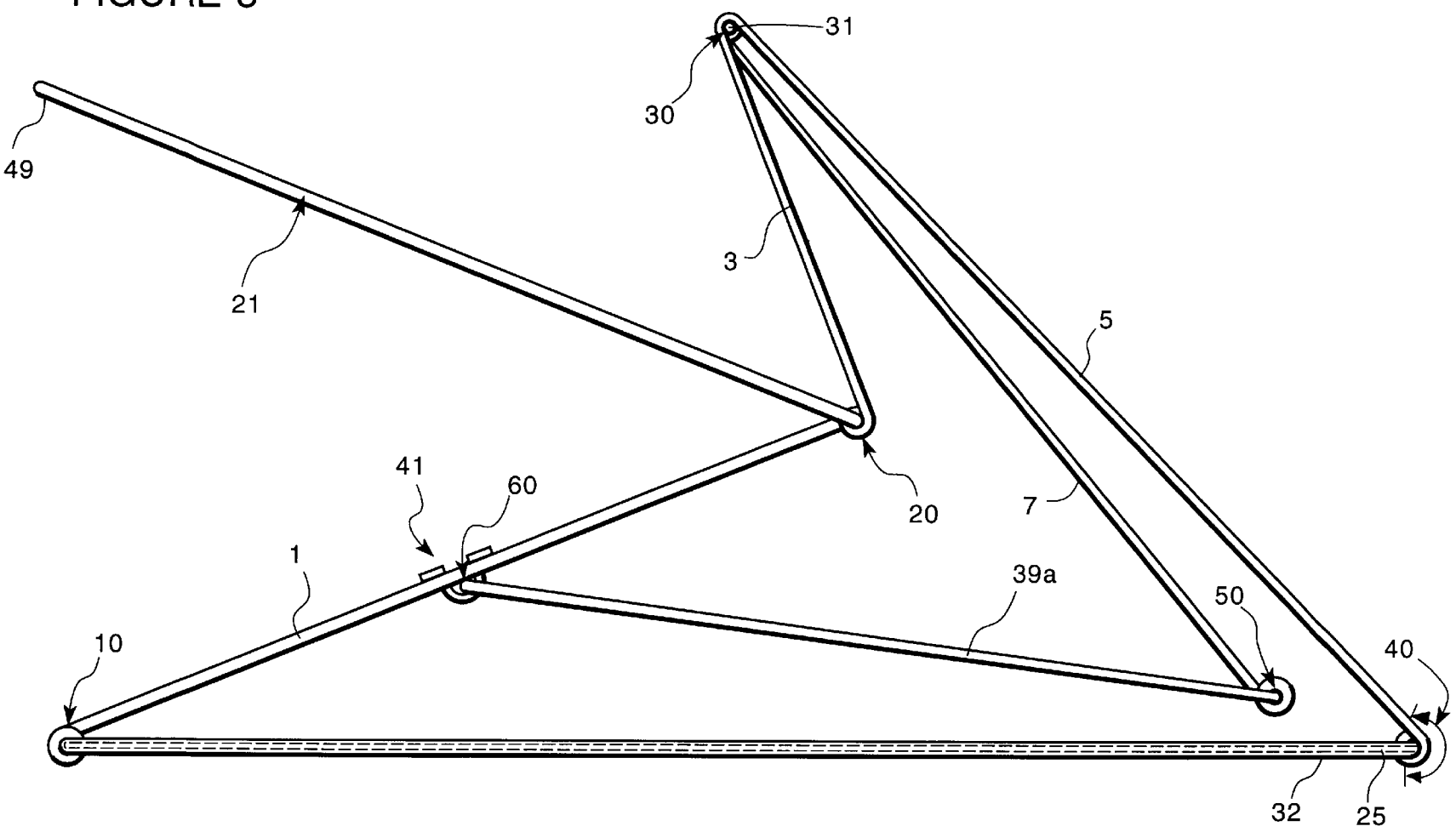
FIG. 3 shows a side view of the reflector oven in a partially closed position.

FIG. 3 schematically illustrates the relative positioning of the reflector oven panels and other components when the reflector oven is in a partially folded or collapsed position with latching wire 21 disengaged from the slot(s) in the support panel(s). The back edge of the top heat reflector panel 1 and the top edge of the back panel 3 form a hinge at pivot point 20 for receiving an arm of latching wire 21. The bottom edge of the back panel 3, the back edge of the shelf 7 and the back edge of the bottom heat reflector panel 5 create hinge at pivot point 30 for receiving a hinge wire 31. The front edge of the bottom reflector panel 5 pivots on the stabilizing frame wire 25 at pivot point 40. The arm 39*a* of the supporting wire extends from pivot point 50 at the front edge of the shelf 7 to pivot point 60 at a u-shaped clip 41 extending from the top heat reflector panel 1. While a functional hinge or pivot point is described above as comprising a sleeve and a wire or a hinge and wire, one skilled in the art would recognize that other hinge or hinge-like devices may be used, as long as they permit folding and unfolding of the reflector oven.

Figure 4:
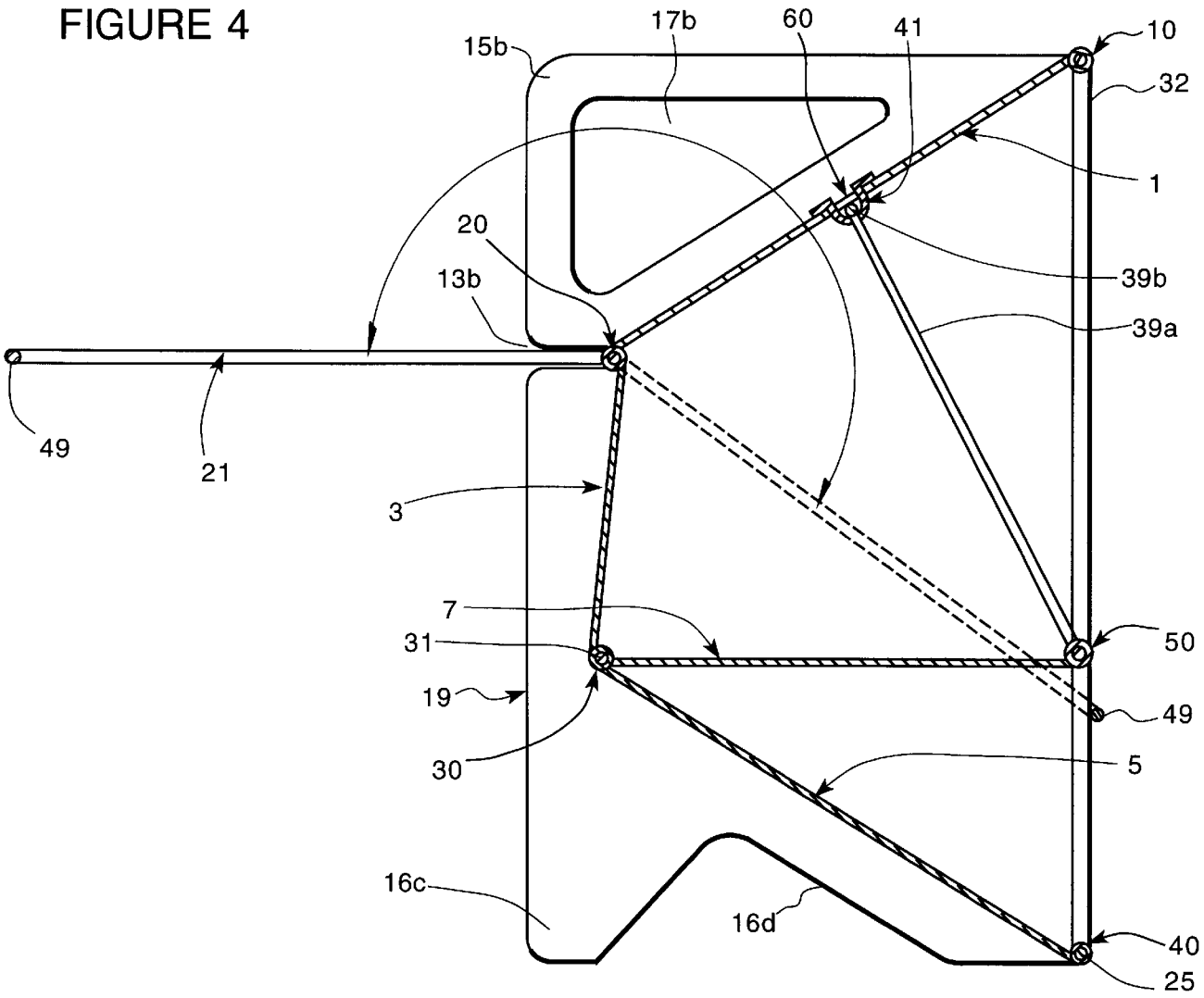
FIG. 4 illustrates a cross-sectional side view of the reflector oven of FIG. 1 and shows a path taken by the latching means of FIG. 1 when moving into and out of a position for holding the support panels against the shelf edge.

FIG. 4 illustrates a cross-sectional side view through the open reflector oven illustrated in FIG. 1 at line FIG. 4—FIG. 4. Each pivot point 10, 20, 30, 40, 50, 60 can be seen. FIG. 4 also illustrates the rotational path taken by the latching wire 21 when securing the reflector oven into an open position for cooking. The support panel 19 has a horizontal slot 13*b*. The reflector oven is unfolded so that the hinge created by the top edge of the back panel 3 and the back edge of the top heat reflector panel 1 through which the latching wire 21 passes is proximal to the horizontal slot 13*b* in the support panel. The support panel 19 is rotated about the wire 25 in sleeve 32 until it is against and substantially at a right angle to the front edge of the shelf 7. The latching wire 21 is rotated so that it is positioned parallel to the slot 13*b* in the support panel 19. The latching wire 21 is fitted into the slot 13*b* such that the latching wire can be freely rotated forward towards the front edge of the top heat reflector panel 1. Then the wire is rotated downwards until the front arm 49 of the latching wire 21 is seated proximal to the front edge of the shelf.

To enhance understanding of the unique folding of the reflector oven panels and components, the pivot points illustrated in FIG. 3, the partially collapsed or folded reflector oven, should be compared with those in FIG. 4, the open or unfolded reflector oven. Referring to FIG. 4, pivot point 10 is shown at the front edge of the top heat reflector 1 proximal to the wire 25. Pivot point 20 is located where the back edge of the top heat reflector 1 is proximal to the top edge of the oven back 3. Pivot point 30 is shown where the bottom edge of the oven back 3 is proximal to the back edge of the oven shelf 7 and proximal to the back edge of the bottom heat reflector 5. Pivot point 40 is shown where the front edge of the bottom heat reflector 5 is proximal to the wire 25. Pivot point 50 is shown where the front edge of the oven shelf 7 is proximal to the supporting wire 39. The bracket-supporting wire pivot point 60 is shown approximately half way between pivot points 10 and 20.

The arms of the frame wire 25 that extend from the top heat reflector panel edge to the bottom heat reflector panel front edge determine the fixed height of the front of the reflector oven when it is in the open position. The reflector oven parts such as for example the shelf and the back panel, should fold within this fixed height. In order to flat fold the reflector oven parts within the fixed height, the heat reflector panels 3, 5 should be of substantially the same width, and the back panel 1 must be substantially half of the width of the reflector panels 3, 5. Similarly, the width of the shelf 7 and the length of each of the arms of the supporting wire, that extend from the top heat reflector panel to the front edge of the shelf, should be substantially the same.

Referring first to FIG. 3, to unfold and latch the reflector oven, reflector panel 1 is forced away from the back panel 3 so that pivot point 20 is distanced from pivot point 50. Referring now to FIG. 4, support panels 9, 19 are freed and are positioned at a right angle to the respective edges of heat reflector panels 1, 5. Positioning of the heat reflector panels also results in the correct positioning (suspension) of the shelf 7. Next, the third arm 49 of the latching wire 21 is rotated from a position proximal to the back of the reflector oven towards pivot point 50 and the latching wire 21 is seated within at least slot 13*a* in at least one support panel 9. The latching wire 21 secures the support panel 9 against a side edge of the shelf 7 thereby stabilizing the reflector oven in the open position. Preferably, the wire is secured in position at slots 13*a*, 13*b* in each support panel 9, 19 respectively.

Figure 5:
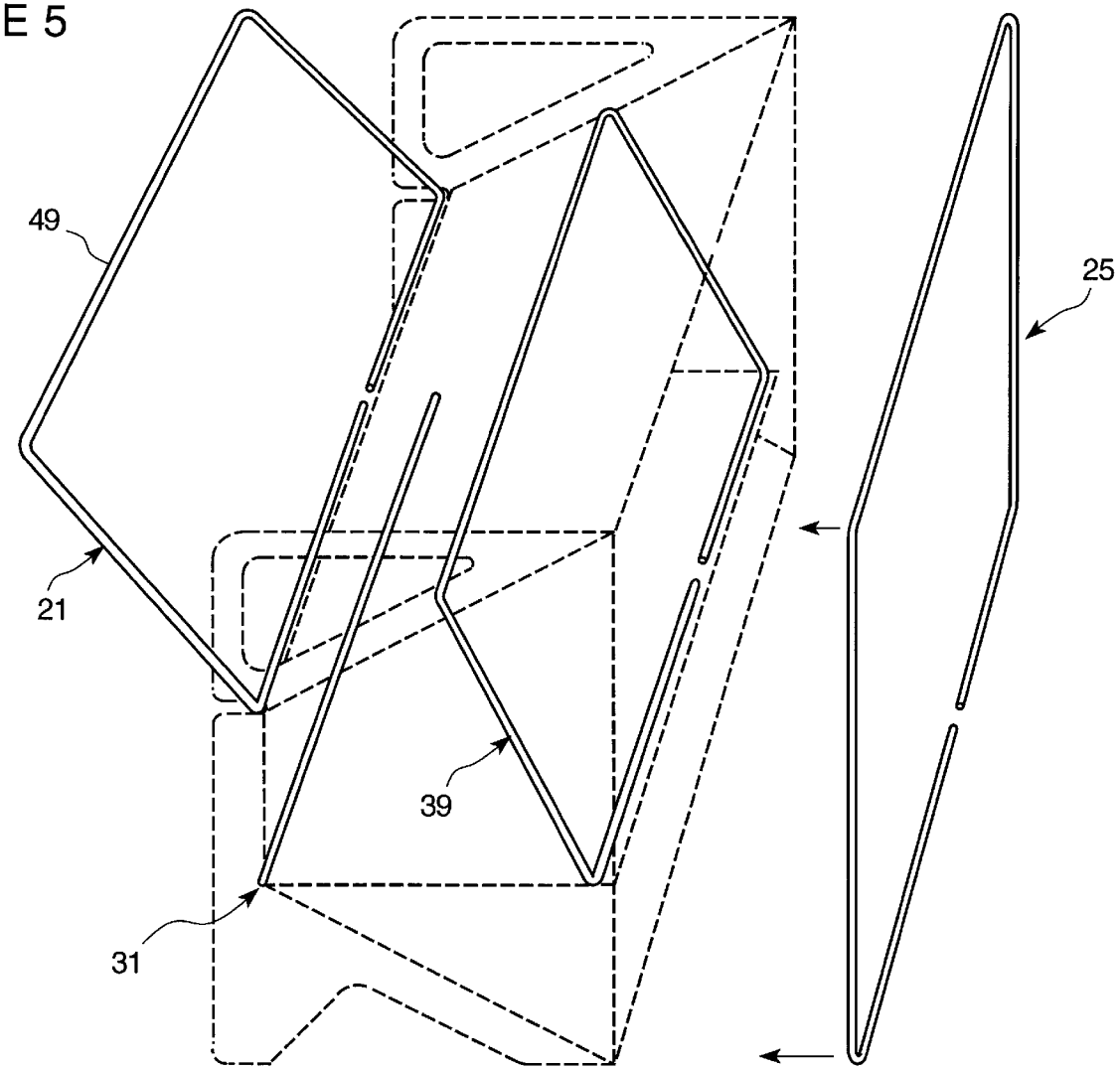
FIG. 5 illustrates the positioning of the pivot point core elements.

FIG. 5 illustrates the positioning of the latching wire 21, the wire 39 suspending the shelf, the hinge wire 31, and the frame wire 25 (in exploded view), especially with respective to the part of each of the wires that is seated within a hinge at a pivot point. Comparing FIG. 4 which illustrates the pivot points with FIG. 5, which illustrates the placement of wires about which the oven components rotate or are hinged. Wire 31 is seated at pivot point 30 which is at the conjunction of the shelf and the back panel. Wire 39 which facilitates automatic alignment of the shelf upon opening of the reflector oven from a folded or collapsed position is illustrated as it would be positioned for shelf suspension. The frame wire 25 is illustrated distanced from the front of the reflector oven and removed from the sleeves in which is positioned as shown in FIG. 1. The latching wire 21 is shown seated at pivot point 20. The latching wire is positioned in the slots 13*a*, 13*b* in a partially latched position, readied for arm 49 to be rotated towards the frame wire to complete the latching of the reflector oven.

The inventive apparatus preferably is made of sheet metal such as for example corrosion resistant aluminum. Not all panels must be made of the same weight sheet metal. In particular, the back panel and bottom panel at least may be made of lighter sheet metal.

Modifications and variations can be made to the disclosed embodiments without departing from the subject and spirit of the invention as defined in the following claims. Such modifications and variations, as included within the scope of these claims, are meant to be considered part of the invention as described.

What is claimed is:

1. A reflector oven having an open configuration and a folded configuration, said reflector oven comprising:

a top panel having a top panel front edge and a top panel back edge;

a back panel having a first back panel edge and an opposing second back panel edge, said top panel back edge pivotally connected to said first back panel edge;

a bottom panel having a bottom panel front edge and a bottom panel back edge, said bottom panel back edge pivotally connected to said opposing second back panel edge;

a shelf having a shelf front edge, a shelf back edge and a shelf side edge, said shelf back edge pivotally engaging said opposing second back panel edge and said bottom panel back edge;

a support panel having a support panel front edge and a support panel back edge, said support panel back edge having a slot;

a means for latching said support panel proximal to said shelf side edge; and a means for pivotally connecting said support panel front edge to said top panel front edge and to said bottom panel front edge.

2. The reflector oven of claim 1 further comprising a means for supporting and positioning said shelf, wherein said means for supporting and positioning said shelf connects said shelf front edge to said top panel.

3. The reflector oven of claim 2 wherein said means for latching is a wire having a first, second, third and fourth side, said first side of said wire pivotally engaging said top panel back edge and said first back panel edge.

4. The reflector oven of claim 3 wherein said means for pivotally connecting said support panel front edge to said top panel front edge and to said bottom panel front edge comprises a frame having at least a first arm, a second arm contiguous with said first arm and a third arm contiguous with said second arm and wherein said top panel front edge has a first sleeve for receiving said first arm, said support panel front edge has a second sleeve for receiving said second arm, and said bottom panel front edge has a third sleeve for receiving said third arm.

5. The reflector oven of claim 4 further comprising a second support panel having a second support panel front edge sleeve, said second support panel front edge sleeve for receiving said means for pivotally connecting, and a second support panel back edge, said second support panel back edge having a second slot for receiving said means for latching.

6. The apparatus of claim 5 wherein said support panel and said second support panel each have a foot and a handle.

7. The reflector oven of claim 2 wherein said means for supporting and positioning said shelf comprises a cutout region in said top panel, a wire extending from said shelf front edge to said cutout region, and a means for supporting said wire at said cutout region.

8. The reflector oven of claim 7 wherein said means for supporting said wire is positioned approximately half way between said top panel front edge and said top panel back edge.

9. The reflector oven of claim 8 wherein said means for supporting said wire is a u-shaped bracket, said u-shaped bracket sized to extend through said cutout region while being supported at said cutout region.

10. The reflector oven of claim 1 further comprising a frame, said frame mounted at said top panel front edge, said bottom panel front edge, and said support panel front edge.

11. A collapsible apparatus for cooking using an open fire comprising:

a frame having a first side, a second side, and a third side;

a first heat reflector panel having a first heat reflector front edge sleeve and a first heat reflector back edge, said first side of said frame pivotally seated in said first heat reflector front edge sleeve;

a back panel having a top edge and a bottom edge, said top edge forming a first pivot point with said first heat reflector panel back edge;

a second heat reflector panel having a second heat reflector front edge sleeve and a second heat reflector back edge;

a shelf having a shelf front edge sleeve, a shelf side edge, and a shelf back edge, said shelf back edge, said second heat reflector back edge and said back panel bottom edge forming a second pivot point;

a pivot wire seated at said second pivot point;

a support panel having a slot, a support panel front edge sleeve and a support panel back edge, said second side of said frame pivotally connected to said support panel at said support panel front edge sleeve; and a latching means for securing said support panel approximately at a right angle relative to said shelf side edge when the collapsible apparatus is used for cooking, said latching means mounted at said first pivot point.

12. The collapsible apparatus of claim 11 further comprising a means for suspending said shelf from said first heat reflector panel, said means for suspending pivotally connecting said shelf front edge sleeve to said first heat reflector panel, said means for suspending configured to allow said shelf to collapse to a position substantially parallel to said first heat reflector panel.

13. The collapsible apparatus of claim 12 wherein said means for suspending comprises a bracket seated approximately half-way between said first heat reflector front edge sleeve and said first heat reflector back edge and a wire for connecting said bracket and said shelf front edge sleeve.

14. The collapsible apparatus of claim 13 wherein said latching means includes a latching wire having a first latching wire side, a second latching wire side, and a third latching wire side, said first latching wire side seated at said first pivot point, said second latching wire side for engaging said support panel at said slot.

15. The collapsible apparatus of claim 13 wherein said bracket is u-shaped.

16. An apparatus for cooking by an open fire comprising:

a latching wire having a front bar, a side bar, and a rear bar;

a frame having a first, second, third and fourth side;

a top heat reflector panel having a front edge and a back edge, said first side of said frame mounted at said front edge of said top heat reflector panel;

a back panel having a top edge and a bottom edge, said top edge of said back panel, said back edge of said top heat reflector panel and said rear bar of said latching wire forming a first pivot point;

a shelf having a front edge and a back edge, said back edge of said shelf connected to said bottom edge of said back panel forming a second pivot point;

and a support panel having a front edge for engaging said second side of said frame, a back edge, and a slot in said back edge of said support panel for receiving said side bar of said latching wire when said apparatus is in an open position.

17. The apparatus of claim 16 wherein said support panel has a handle for lifting and rotating said apparatus.

18. The apparatus of claim 17 further comprising a bottom heat reflector panel, said bottom heat reflector panel having a front edge for engaging said frame and having a back edge for engaging said bottom edge of said back panel at said second pivot point.

19. The apparatus of claim 18 further comprising a means for suspending said shelf, said means for suspending said shelf pivotally connecting said front edge of said shelf and said top heat reflector panel.

20. The apparatus of claim 19 wherein said means for suspending said shelf comprises a wire and a wire mounting means, said wire mounting means connected to said top heat reflector panel and said wire pivotally engaging said wiring mounting means and said shelf.

* * * * *